US009033340B2

(12) United States Patent
Duesterhus

(10) Patent No.: US 9,033,340 B2
(45) Date of Patent: May 19, 2015

(54) DEVICE FOR DISBURSING VALUE NOTES COMPRISING A STATIONARY SUPPORT ELEMENT

(75) Inventor: Richard Duesterhus, Paderborn (DE)

(73) Assignee: WINCOR NIXDORF INTERNATIONAL GMBH (DE)

( * ) Notice: Subject to any disclaimer, the term of this patent is extended or adjusted under 35 U.S.C. 154(b) by 0 days.

(21) Appl. No.: 13/806,062

(22) PCT Filed: Jun. 22, 2011

(86) PCT No.: PCT/EP2011/060438

§ 371 (c)(1),
(2), (4) Date: Dec. 20, 2012

(87) PCT Pub. No.: WO2011/161155

PCT Pub. Date: Dec. 29, 2011

(65) Prior Publication Data

US 2013/0099439 A1 Apr. 25, 2013

(30) Foreign Application Priority Data

Jun. 23, 2010 (DE) ..... 10 2010 017 547

(51) Int. Cl.
*B65H 29/40* (2006.01)
*G07D 11/00* (2006.01)
(Continued)

(52) U.S. Cl.
CPC ..... *G07D 11/00* (2013.01); *B65H 1/26* (2013.01); *B65H 29/40* (2013.01);
(Continued)

(58) Field of Classification Search
CPC ..... B65H 29/40
USPC ..... 271/315
See application file for complete search history.

(56) References Cited

U.S. PATENT DOCUMENTS 4,320,854 A * 3/1982 Hirose ..... 221/12
4,434,359 A * 2/1984 Watanabe ..... 235/379
(Continued)

FOREIGN PATENT DOCUMENTS

CN 101100248 A 1/2008
DE 3519635 C2 10/1988
(Continued)

OTHER PUBLICATIONS

International Search Report (in German and English) and Written Opinion (in German) for PCT/EP2011/060438, mailed Oct. 26, 2011; ISA/EP.
(Continued)

*Primary Examiner* — Luis A Gonzalez
(74) *Attorney, Agent, or Firm* — Harness, Dickey & Pierce, P.L.C.

(57) ABSTRACT

The invention relates to a device (10, 40, 80) for dispensing notes of value (52) comprising a dispensing unit (16) for dispensing a stack of notes of value (54) and a supply transport arrangement (26) for individually supplying the notes of value (52) to be dispensed to a collecting unit (28) for collecting and stacking the notes of value (52). The collecting unit (28) comprises a stacking unit (46) and a support element (50) that is stationarily arranged, wherein the stacking unit (46) stacks the notes of value (52) onto the support element (50) to the stack of notes of value (54). Further, the collecting unit (28) comprises a press-on element (62) that is stationarily arranged and that can be swiveled and that during stacking the notes of value is arranged in a swiveled-away position, and for dispensing the stack of notes of value is arranged in a swiveled-on position.

9 Claims, 12 Drawing Sheets

(51) Int. Cl.
*B65H 1/26* (2006.01)
*B65H 31/30* (2006.01)

(52) U.S. Cl.
CPC ... *B65H 31/3027* (2013.01); *B65H 2404/2614* (2013.01); *B65H 2408/13* (2013.01); *B65H 2511/212* (2013.01); *B65H 2511/414* (2013.01); *B65H 2701/1912* (2013.01); *G07D 11/0021* (2013.01)

(56) References Cited

U.S. PATENT DOCUMENTS

| | | | | |
|---|---|---|---|---|
| 4,462,509 | A * | 7/1984 | Adelberger | 221/259 |
| 4,616,817 | A * | 10/1986 | Yamauchi et al. | 271/111 |
| 4,854,452 | A | 8/1989 | Uchida et al. | |
| 6,019,209 | A * | 2/2000 | Hara et al. | 194/206 |
| 6,276,678 | B1 | 8/2001 | Nottelmann et al. | |
| 2006/0144922 | A1 | 7/2006 | Park et al. | |
| 2007/0257427 | A1* | 11/2007 | Crerar | 271/315 |
| 2012/0211935 | A1 | 8/2012 | Petermann et al. | |

FOREIGN PATENT DOCUMENTS

| | | | |
|---|---|---|---|
| DE | 197 48 864 | A1 | 5/1999 |
| DE | 10203175 | C1 | 6/2003 |
| DE | 10247473 | A1 | 4/2004 |
| EP | 0489943 | A1 | 6/1992 |
| EP | 0517404 | A2 | 12/1992 |
| GB | 2161145 | A | 1/1986 |
| JP | 2001-022995 | A | 1/2001 |
| WO | WO-2009-000394 | A1 | 12/2008 |

OTHER PUBLICATIONS

Notification of Transmittal of Translation of the International Preliminary Report on Patentability issued in PCT/EP2011/060438, mailed Jan. 10, 2013; ISA/EP.

Chinese Office Action for Application No. 2010-022-400-943-550 dated Sep. 26, 2014 with English Translation (20 pages).

* cited by examiner

DEVICE FOR DISBURSING VALUE NOTES COMPRISING A STATIONARY SUPPORT ELEMENT

CROSS-REFERENCE TO RELATED APPLICATIONS

This application is a National Stage of International Application No. PCT/EP2011/060438, filed Jun. 22, 2011, and published in German as WO 2011/161155 A1 on Dec. 29, 2011. This application claims the benefit and priority of German Application No. 10 2010 017 547.1, filed Jun. 23, 2010. The entire disclosures of the above applications are incorporated herein by reference.

BACKGROUND

This section provides background information related to the present disclosure which is not necessarily prior art.

Technical Field

The invention relates to a device for dispensing notes of value comprising a dispensing unit for dispensing a stack of notes of value from which notes of value are to be dispensed, and a supply transport arrangement that individually supplies the notes of value to a collecting unit for collecting and stacking the notes of value to be dispensed.

Discussion

From document WO 2009/000394 A1 an automated teller machine is known comprising a processing chain for transporting and processing supplied notes of value and notes of value to be dispensed, wherein the processing chain is provided with two processing circuits.

From document DE 102 47 473 A1 a collecting device for forming wads of banknotes is known. The wads of banknotes can be supplied to a majority of dispensing stations, wherein the wads of banknotes are transported by means of a transport carriage from a stacking device to the dispensing stations. The controlling of the transport paths to the different dispensing stations is carried out by means of a pivoting gate.

The problem with using such a transport carriage for transporting the wads of banknotes from the stacking unit to a dispensing station is that here a relatively large space is required and the required mechanics is complicated and cost-intensive.

SUMMARY OF THE INVENTION

It is an object of the invention to designate a device for dispensing notes of value, wherein the notes of value to be dispensed are easily stacked to a stack of notes of value and this stack of notes of value can easily be dispensed.

By providing a support element stationarily arranged on which a stacking unit stacks the notes of value of the stack of notes of value to be dispensed with their front and/or reverse sides lying on top of one another to the stack of notes of value and to a press-on element that is also stationarily arranged and which during stacking of the notes of value is arranged in a swiveled-away position and which for dispensing the stack of notes of value is arranged in a swiveled-on position in which it presses the stack of notes of value against the support element, a simple and space-saving assembly of the collecting unit is achieved. Different than in the prior art by stationarily arranging the support element and the press-on element no movement of a transport carriage is necessary. The collecting unit is in particular arranged in the immediate vicinity of the output compartment of the dispensing unit, so that the stack of notes of value can be taken directly by the user of the device from the collecting unit when the output compartment is opened.

The stacking of the notes of value on the support element can be in particular a vertical stacking or a horizontal stacking. Further, the support element can also be arranged in an angle between 0° and 90° relative to the vertical.

In particular, the device for dispensing notes of value is a cash dispensing machine. Alternatively, the device can be a cash recycling automated teller machine in which notes of value can be deposited and dispensed. Further, the device can be an automatic cash register system or an automatic cash safe.

In the swiveled-on position compared to the swiveled-away position the press-on element is rotated by a preset angle around the axis of rotation. This preset angle has in particular a value between 40° and 90° . By this, due to the small preset angle by which the press-on element is swiveled, only little installation space is required, achieving a compact and space-saving installation.

The stacking unit comprises at least one stacker wheel, preferably several stacker wheels by means of which the notes of value can be stacked easily on the support element. By this, a secure, reliable and easy stacking is achieved.

The support element preferably comprises one belt that contacts at least one of the notes of value of the stack of notes of value to be dispensed, and which for dispensing the stack of notes value by means of a dispensing opening of the dispensing unit can be driven by a drive unit and transports the stack of notes of value in direction of the dispensing unit.

In this way, it is achieved in a simple manner that the stack of notes of value is presented to a user through the dispensing opening and that the user can easily withdraw the stack of notes of value without requiring components of the collecting unit to be moved in direction of the dispensing opening. In a preferred embodiment of the invention several belts, in particular two belts are provided, achieving a continuous transport of the stack of notes of value over the entire length of the stack of notes of value and avoiding in particular a torsion of the stack of notes of value.

The collecting unit preferably comprises a partition element that can be swiveled and that during stacking of the notes of value is arranged in a closed position in which it locks a return transport of the stack of notes of value in a return transport path. In this way, it is achieved that the notes of value do not inadvertently slip into the return transport path and can be offered securely to the user. It is especially advantageous if in any case an edge of the note of value of the stack of the notes of value contacts the partition element, achieving a secure and reliable position of the notes of value of the stack of notes of value.

An adjusting unit swivels the partition element for transporting a stack of notes of value to the return transport path, preferably from the closed position in an open position, so that that stack of notes of value can be transported from the collecting unit to the return transport path. In case the user does not withdraw the stack of notes of value he or she has asked for, this stack of notes of value has to be returned from the collecting unit via the return transport path, so that the collecting unit can collect and stack the notes of value to be dispensed for further cash dispensing operations. By adjusting the partition element from the closed position to the open position such a return transport of the not-withdrawn stack of notes of value can be carried out in a simple manner. Even in case of a multiple-sheet feed of notes of value, in which case it is not guaranteed that the user gets the desired number and/or denomination of notes of value the stack of notes of value has to be returned via the return transport path. This stack of notes of value is as well transported back via the open partition element in a simple manner. The notes of value that have been transported back via the return transport path are in particular deposited in a so-called reject and retract cassette provided for this purpose.

For transporting the stack of notes of value from the collecting unit to the return transport path the belt or the several belts of the support element are driven in particular in the opposite direction from the direction in which they are driven by the drive unit for dispensing the stack of notes of value. In this manner, the return transport of the stack of notes of value is achieved easily without requiring additional transport elements within the collecting unit.

In the return transport path in particular a separating unit is arranged that separates the notes of value of the stack of notes of value before these are transported further to the reject and retract cassette.

The notes of value to be dispensed are in particular removed from a cash box arranged in a safe. The removed notes of value are supplied to the supply transport arrangement along a transport path via a transfer opening of the safe.

BRIEF DESCRIPTION OF THE DRAWINGS

The drawings described herein are for illustrative purposes only of selected embodiments and not all possible implementations, and are not intended to limit the scope of the present disclosure.

Further features and advantages of the invention result from the following description which in connection with the enclosed Figures explains the invention in more detail with reference to embodiments.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

Figure 1:
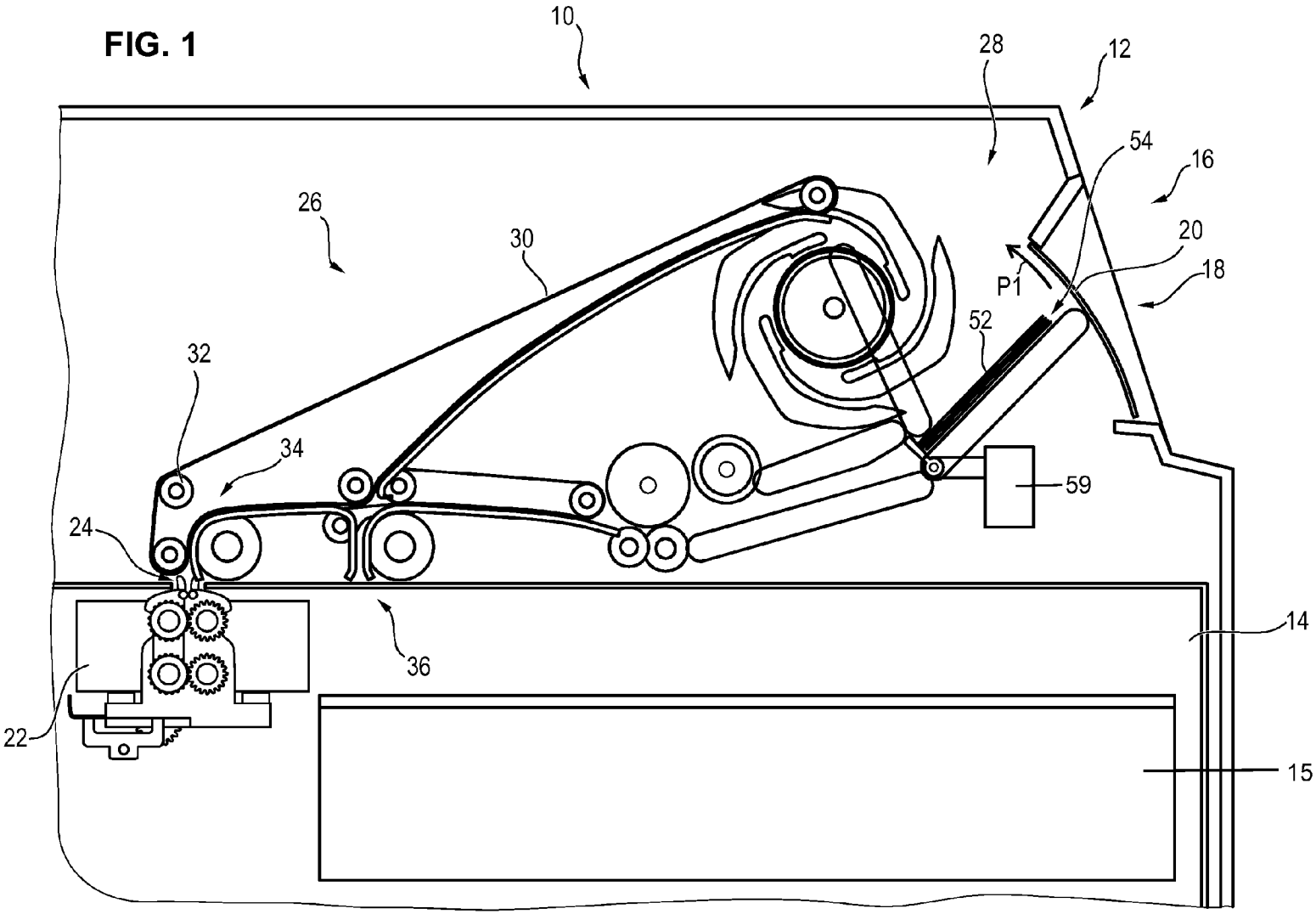
FIG. 1 is a section of a schematic illustration of an automated teller machine according to a first embodiment of the invention.

FIG. 1 shows a schematic illustration of a section of a device designed as automated teller machine 10 for dispensing notes of value. The automated teller machine comprises a so-called head module 12 and a safe 14. In the safe 14 at least one, preferably several cash boxes 15 are accommodated that are not illustrated in FIG. 1 in which the notes of value are stored that are to be dispensed by means of the automated teller machine 10.

In the head module 12 of the automated teller machine 10 a dispensing unit 16 is arranged comprising an operating unit through which a user can input a withdrawal request. The notes of value to be dispensed are issued to the user via a dispensing opening 18 in form of a stack of notes of value 54. The dispensing opening 18 can be closed by means of a flap 20 that can be swiveled in direction of the arrow P1. For dispensing the stack of notes of value 54 the flap 20 is opened in direction of the arrow P1, so that the user can remove the stack of notes of value 54 through the dispensing opening 18.

After the user has input the withdrawal request via the dispensing unit 18 the notes of value required for dispensing are removed from the cash boxes by means of separating modules and are supplied to a transport path. The transport path comprises a transfer module 22 by means of which the notes of value that are to be dispensed and that are removed from the cash boxes are handed over through a transfer slot 24 from the safe 14 to a supply transport arrangement 26. The supply transport arrangement 26 comprises a multitude of conveyor belts supported on rolls that can be driven and by means of which the removed notes of value can be supplied to a collecting unit 28. One of these belts is exemplarily identified with the reference sign 30, one of the rolls exemplarily with the reference sign 32.

Figure 2:
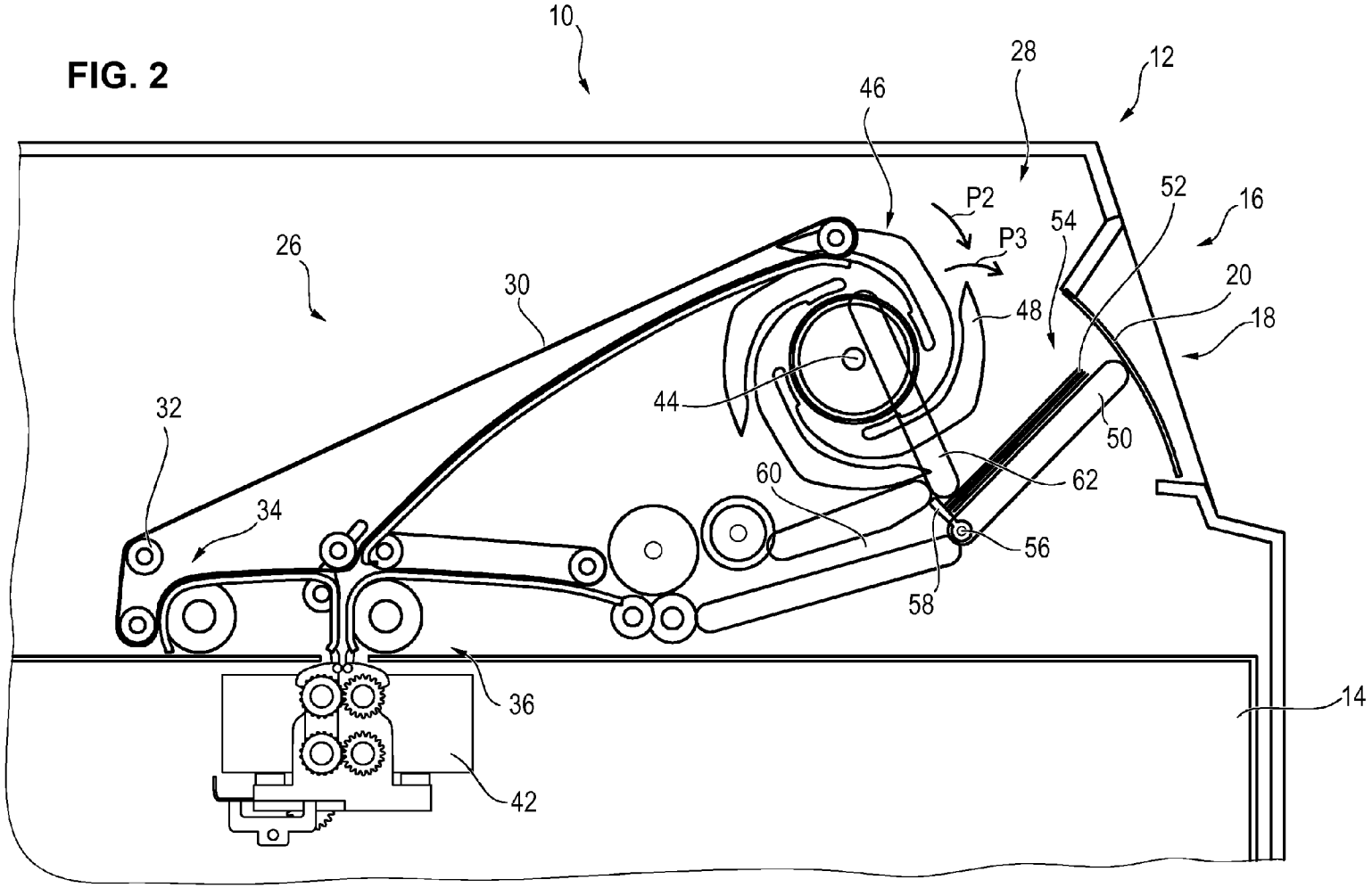
FIG. 2 is a section of a schematic illustration of an automated teller machine according to a second embodiment of the invention in a first operating state.
Figure 3:
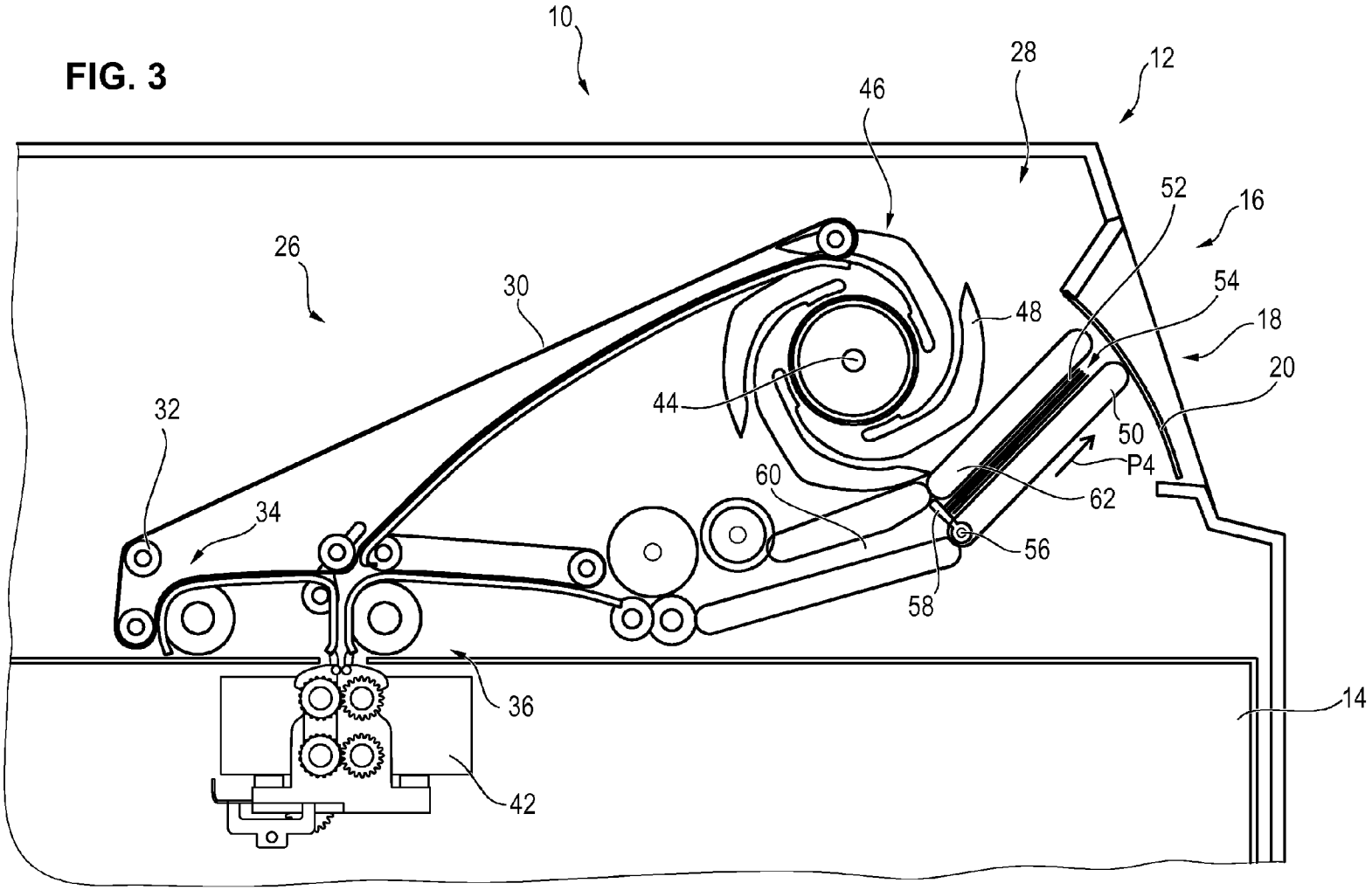
FIG. 3 is a section of a schematic illustration of the automated teller machine according to FIG. 2 in a second operating state.
Figure 4:
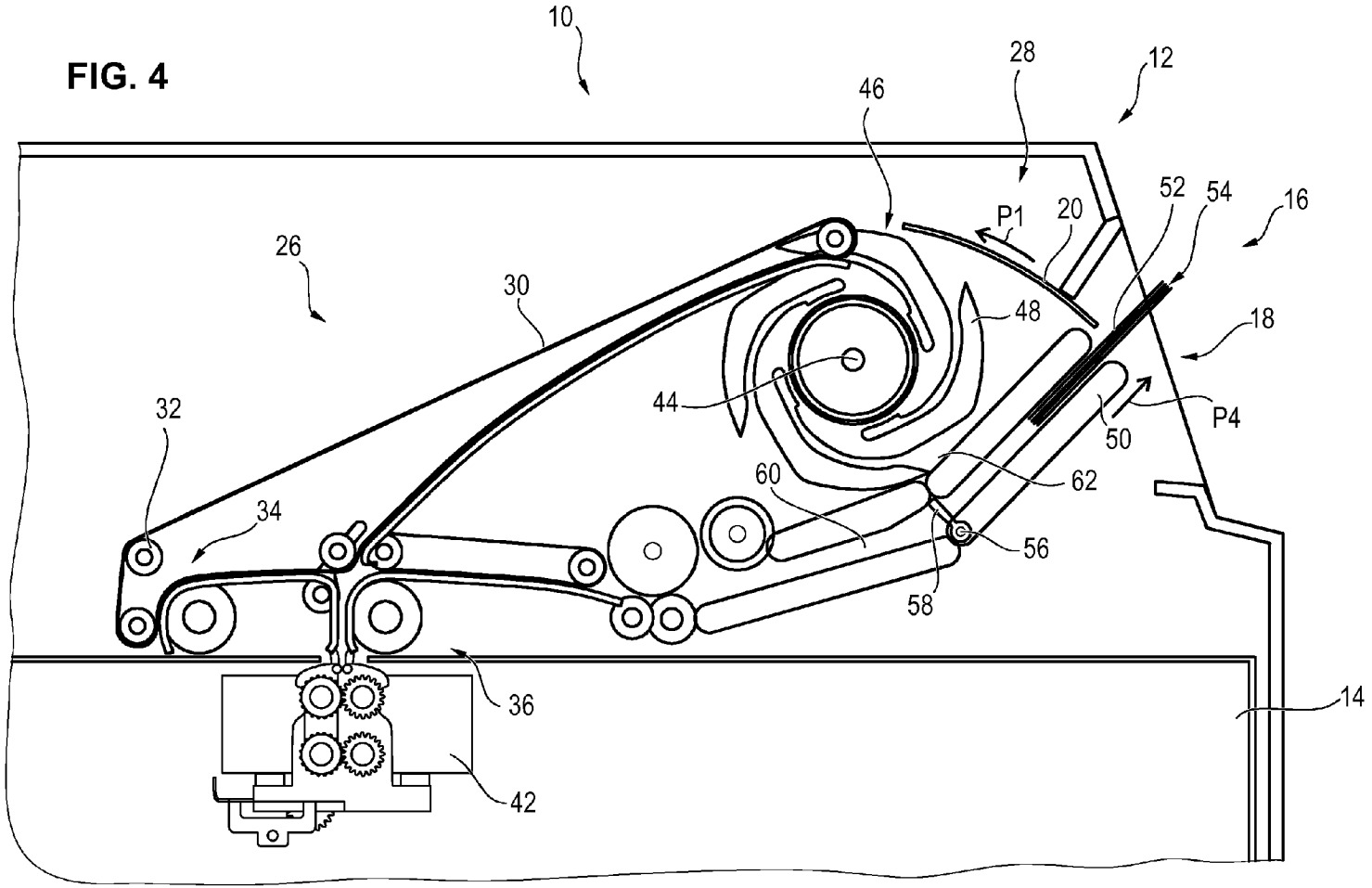
FIG. 4 is a section of a schematic illustration of the automated teller machine according to the FIGS. 2 and 3 in a third operating state.

The supply transport arrangement 26 comprises a first receiving mechanism 34 by means of which the notes of value supplied by the safe 14 are received by the supply transport arrangement 26. Further, the supply transport arrangement 26 comprises a second receiving mechanism 36 by means of which notes of value, as shown in FIGS. 2 to 4 can be received by the safe 14, if the safe 14 is equipped with cash boxes at the rear, i.e. at the side opposite to the dispensing unit 16. However, in FIG. 1 the automated teller machine 10 is arranged such that the cash boxes in the safe 14 are supplied from the front, i.e. from the side at which the dispensing unit 16 is arranged as well. In this case the notes of value are supplied from the transfer module 22 to the supply transport arrangement 26 exclusively via the first receiving mechanism 34.

FIG. 2 shows a schematic perspective illustration of an automated teller machine according to a second embodiment of the invention. Elements having the same structure or the same function are identified with the same reference signs. In this second embodiment of the invention the safe 14 is equipped with cash boxes from the rear, so that the notes of value to be dispensed are supplied to the supply transport arrangement 26 by means of a transfer module 42 via the second receiving mechanism.

The notes of value to be dispensed are supplied to the collecting unit 28 by means of the supply transport arrangement 26. The collecting unit 28 comprises several stacker wheels that are arranged on a shaft 44, one of which is exemplarily identified with the reference sign 46. The stacker wheel 46 comprises four vanes 48, wherein in each case between two adjacent vanes 48 a note of value supplied via the supply transport arrangement 26 is clamped and is moved along in case of a rotation of the stacker wheel 46 in direction of the arrow P2. In an alternative embodiment of the invention the stacker wheels 46 can also comprise less or more than four vanes 48.

After the stacker wheels 46 have rotated around a preset angle in direction of the arrow P2, the notes of value clamped between the vanes 48 are each stripped off via strip-off elements not illustrated in FIG. 2, and are stacked onto a support element 50. Thereby, the notes of value are stacked on top of one another, such that they are stacked on top of one another with the front and/or reverse sides lying on top of each other, wherein the note of value supplied at first contacts the support element 50.

One of the notes of value to be dispensed is exemplarily identified with the reference sign 52, the stack of notes of value to be dispensed with the reference sign 54.

The notes of value 52 of the stack of notes of value 54 contact with one of their edges, preferably in each case with one of their longitudinal edges, a partition element 58 that can be swiveled around an axis 56 by adjustment unit 59, preventing the notes of value 52 from slipping into a return transport path 60, if the partition element 58 is arranged in a closed position as shown in FIG. 2.

Furthermore, the collecting unit comprises a press-on element 62 by means of which for cash dispensing the notes of value 52 of the stack of notes of value 54 can be pressed against the support element 50. In the first operating state as shown in FIG. 2 the press-on element 62 is arranged in a swiveled-away position, so that the notes of value 52 stripped-off by means of the strip-off elements can be stacked onto the support element 50 to the stack of notes of value 54.

FIG. 3 shows a section of a schematic illustration of the automated teller machine 40 according to FIG. 2 in a second operating state. After all notes of value 52 of the stack of notes of value 54 to be dispenses have been stacked onto the support element 50, the press-on element 62 is swiveled from the swiveled-away position to a swiveled-on position in which it presses the stack of notes of value 54 against the support element 50.

The support element 50 comprises at least one belt that can be driven via a drive unit and by means of which the notes of value can be transported in direction of the arrow P4 in direction of the dispensing opening 18. The press-on element 62 serves in particular to generate the contact pressure required for a reliable transport of the stack of notes of value 54 in direction of the arrow P4.

In a preferred embodiment of the invention the support element 52 comprises at least two belts, guaranteeing a continuous transport of the stack of notes of value 54 over the entire width of the notes of value 52. Additionally or alternatively to the belts of the support element 50 the press-on element 62 can comprise one or several belts by means of which the notes of value 52 of the stack of notes of value 54 can be transported in direction of the output opening 18. As shown in FIG. 4, for dispensing the stack of notes of value 54 the flap 20 of the dispensing unit 14 is swiveled in direction of the arrow P1, enabling access of the user to the dispensing opening 18. After the flap 20 has been swiveled, the stack of notes of value 54 is transported so far in direction of the arrow P4 that it can be removed easily by the user. In case the stack of notes of value 54 is not removed within a preset time interval by the user or by another person, it is transported back opposite to the direction of the arrow P4. For this purpose, the belts of the support element 50 and/or the belts of the press-on element 62 are driven in the opposite direction to which they had been driven in direction of the arrow P4 for transport of the stack of notes of value 54. As soon as the stack of notes of value 54 does no longer protrude from the output opening 18, the flap 20 is closed again, so that access to the inside elements of the automated teller machine 40 is not possible.

Subsequently, the not-removed stack of notes of value 54 is supplied again from the collecting 28 to the safe 14 via the return transport path 60. In the safe 14 in particular a so-called reject and retract cassette is provided in which such not-removed stacks of notes of value 54 are stored.

Even in case that during removal of the notes of value 52 to be dispensed from the cash boxes a multiple-sheet feed occurs, the notes of value 52 of the stack of notes of value 54 have to be supplied back to the safe 14 via the return transport path 60, as due to the multiple-sheet feed it cannot be guaranteed that the user receives the desired amount of money.

Figure 5:
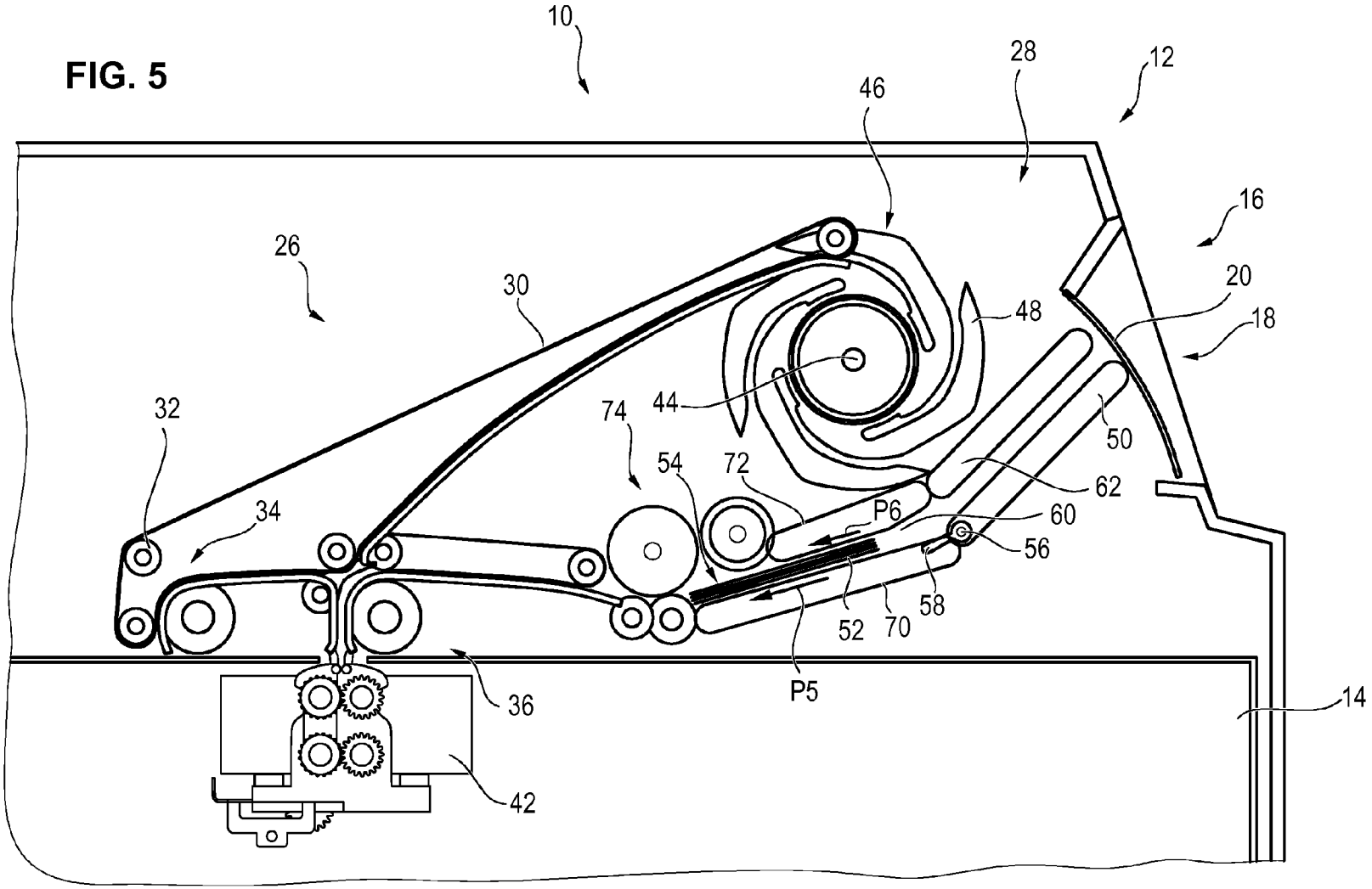
FIG. 5 is a section of a schematic illustration of the automated teller machine according to the FIGS. 2 to 4 in a fourth operating state.

For return transport of the notes of value via the return transport path 60 the partition element 58 is swiveled from the closed position to an open position. FIG. 5 shows a schematic illustration of the automated teller machine 20 in which the partition element 58 is arranged in the open position. By means of driving the belts of the support element 50 and/or of the press-on element 62 opposite to the direction of the arrow P2 and/or by means of driving the belts 70, 72 limiting the return transport path 62 the stack of notes of value 52 is supplied to a separating unit 74. By means of the separating unit 74 the notes of value 52 of the stack of notes of value are separated again, so that the notes of value 52 can be individually supplied back to the safe 14 via the transfer module 42.

In an alternative embodiment of the invention the stack of notes of value 54 that is transported to the return transport path 60 is supplied to the safe 14 as a whole, so that a prior separating of the notes of value 52 is not necessary. By separating the notes of value 52 in the present embodiment it is achieved that the transport elements by means of which the notes of value are again supplied from the separating module 74 to the safe 14, and that the transport elements by means of which the notes of value 52 are transported in the safe 14 only have to be designed such that by means of them in each case a note of value 52 can be transported at the same time.

Figure 6:
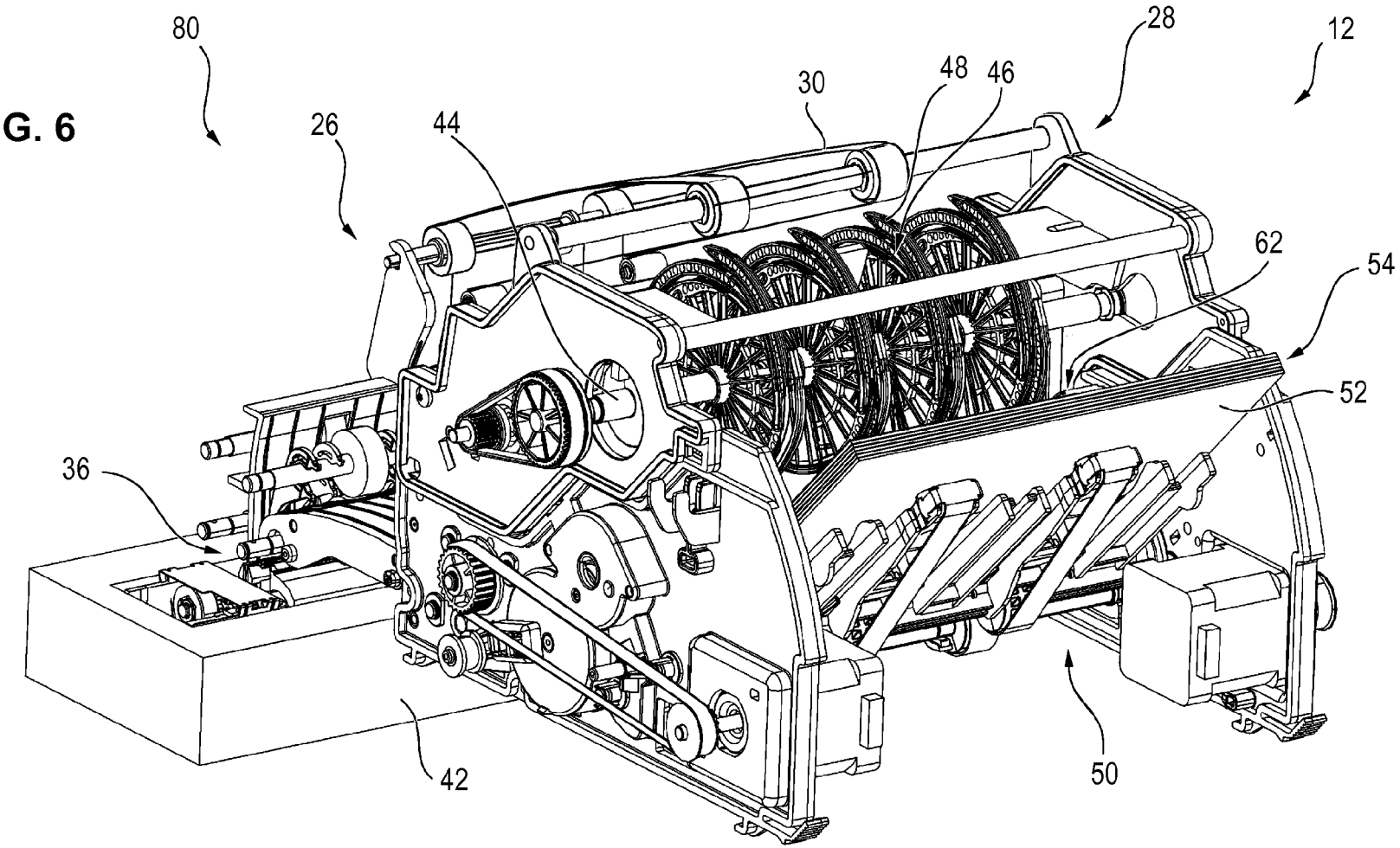
FIG. 6 is a schematic perspective illustration of a section of an automated teller machine according to a third embodiment of the invention.
Figure 7:
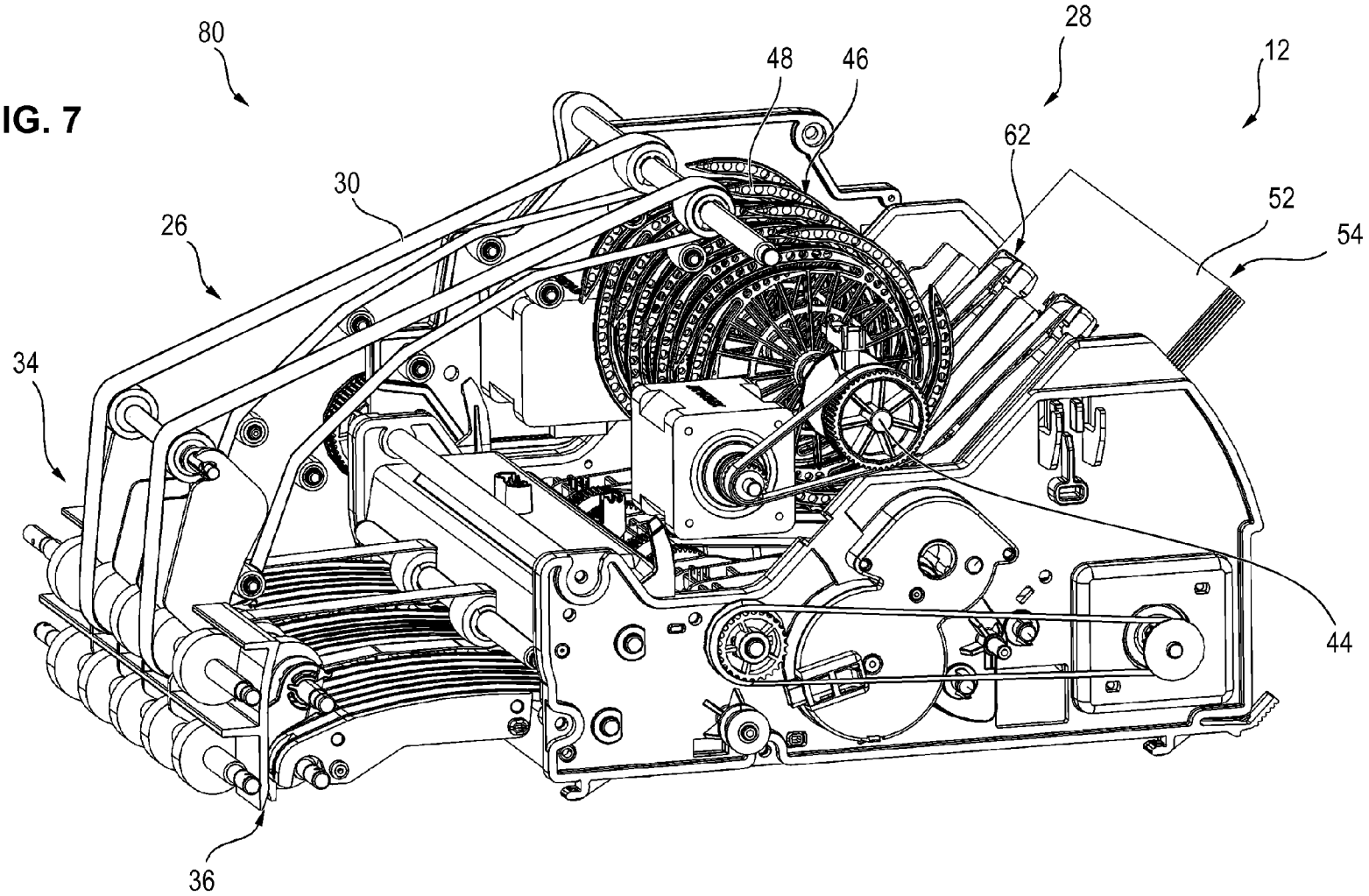
FIG. 7 is a further schematic perspective illustration of the automated teller machine according to FIG. 6.

FIG. 6 shows a schematic perspective illustration of a section of an automated teller machine 80 according to a third embodiment of the invention. Here, only a part of the head module 12 as well as the transfer module 42 of the safe 14 are shown. FIG. 7 shows a further schematic perspective illustration of the section of the automated teller machine 80 according to FIG. 6. In the third embodiment the removal of the notes of value 52 to be dispensed or the returning of not-removed notes of value or of notes of value of stacks of notes of value with multiple-sheet feeds is carried out via the second receiving mechanism 38.

Figure 8:
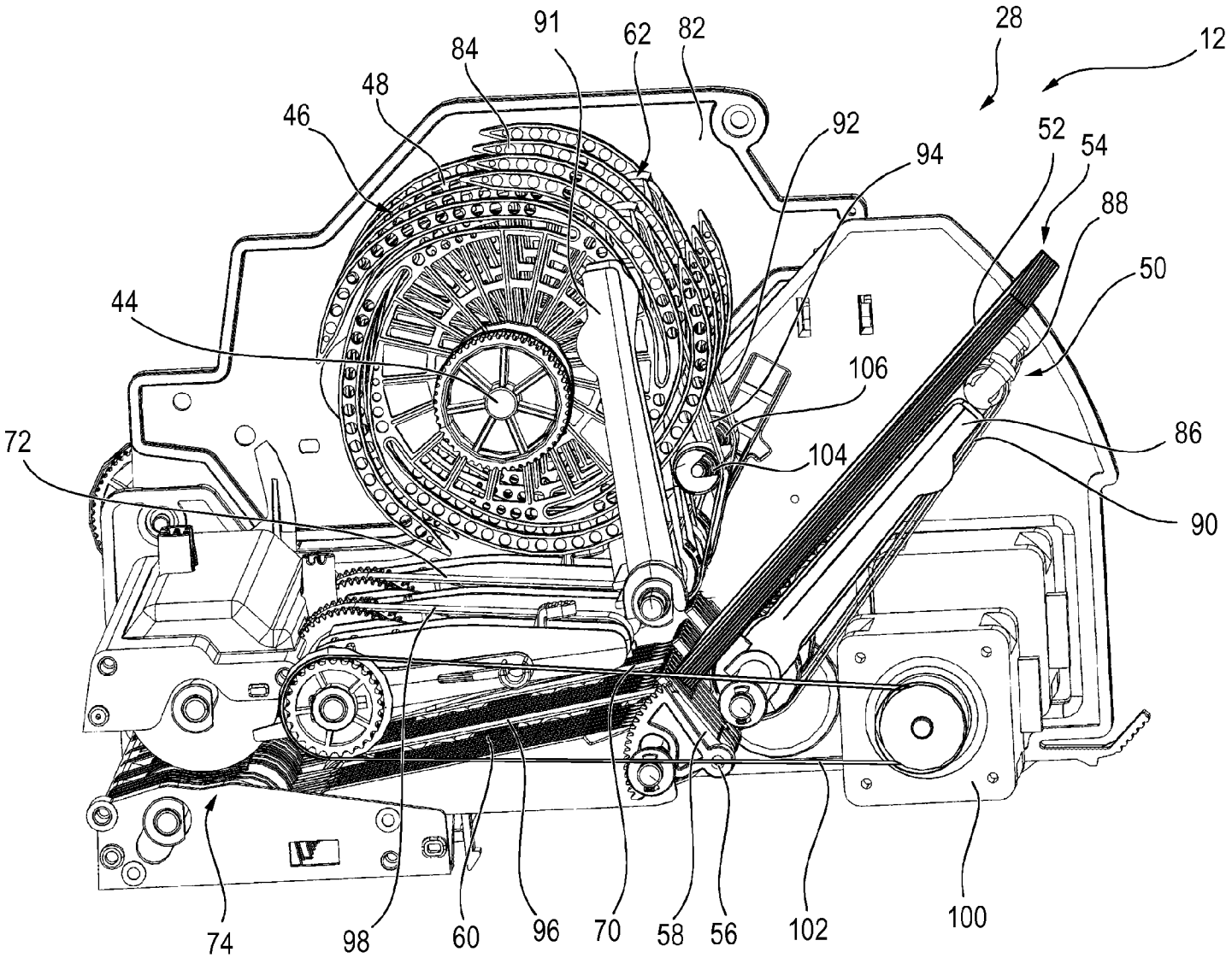
FIG. 8 is a schematic perspective illustration of a collecting unit of the automated teller machine according to FIGS. 6 and 7 in the first operating state.

FIG. 8 shows a schematic perspective illustration of a section of the collecting unit 28 as well as of the return transport path 60 and of the separating unit 74. Here, only the rear side wall 82 is shown. For reasons of clarity the front side wall is not shown. In this embodiment the collecting unit 28 comprises four stacker wheels 46, wherein the vanes 48 of the stacker wheels 46 each comprise several holes 84 by means of which the weight of the stacker wheels 46 is reduced.

The support element 50 comprises a base body 86 as well as two belts 88, 90. The press-on element 62 also comprises a base body 91 as well as two belts 92, 94. FIG. 8 shows the press-on element 62 in the swiveled-away position, so that the notes of value 52 can be stacked onto the support element 50. The return transport path 60 is limited by four belts 70, 72, 96, 98. The belts 70, 72, 96, 98 can be driven by means of a step motor 100 via a belt 102.

Figure 9:
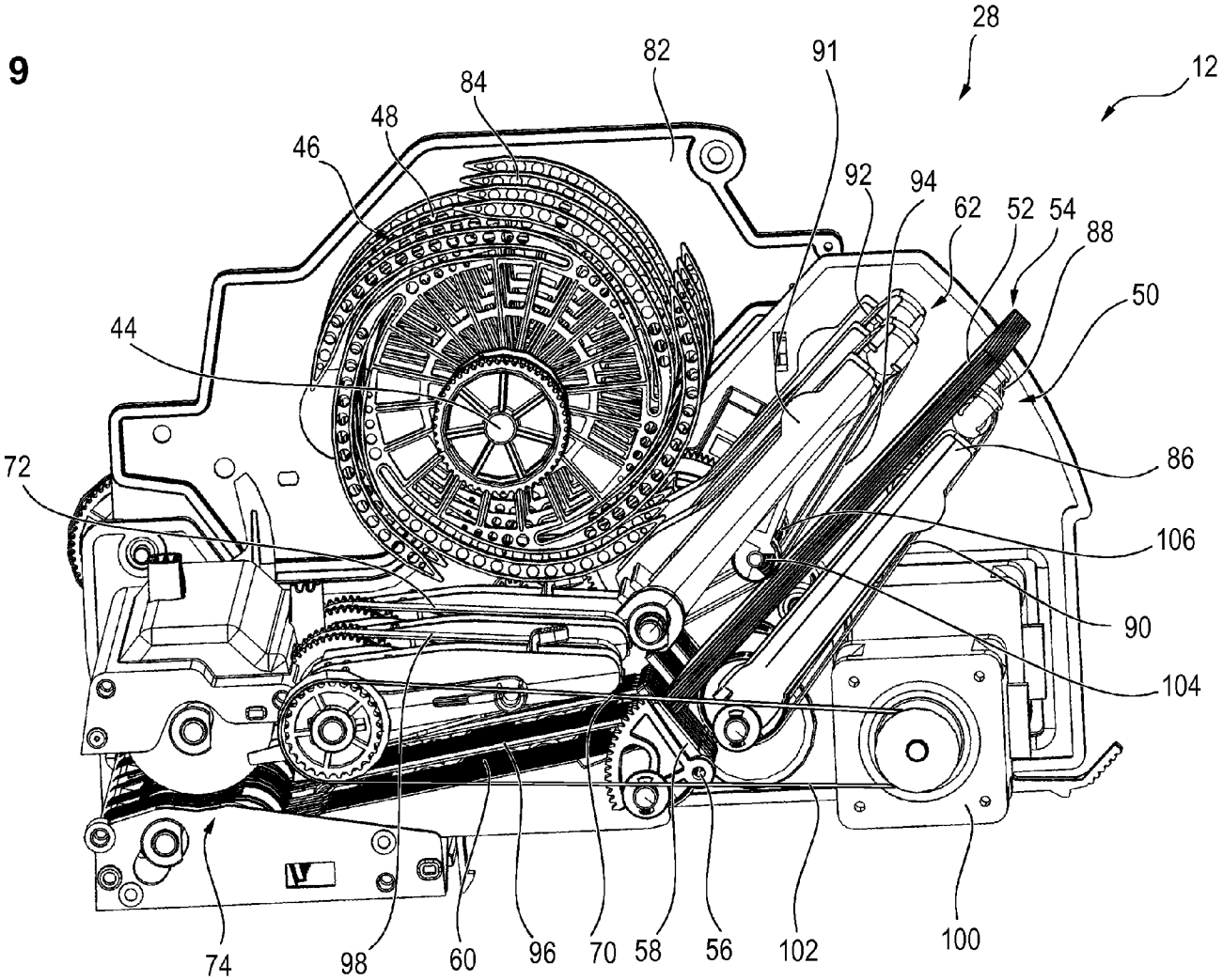
FIG. 9 is a schematic perspective illustration of the collecting unit according to FIG. 8 in the second operating state.

FIG. 9 shows a schematic perspective illustration of the arrangement according to FIG. 8 in the second operating state. After all notes of value 52 of the stack of notes of value 54 had been stacked onto the support element 50, the press-on element 62 was swiveled, so that the belts 92, 94 of the press-on element 62 contact the stack of notes of value 54 and press it against the support element 50. The belts 92, 94 are each tensioned via a spring-mounted roll 104, 106, so that the stack of notes of value 54 is pressed against the support element 50 at a sufficiently high pressure, independent of the number of notes of value 52.

Figure 10:
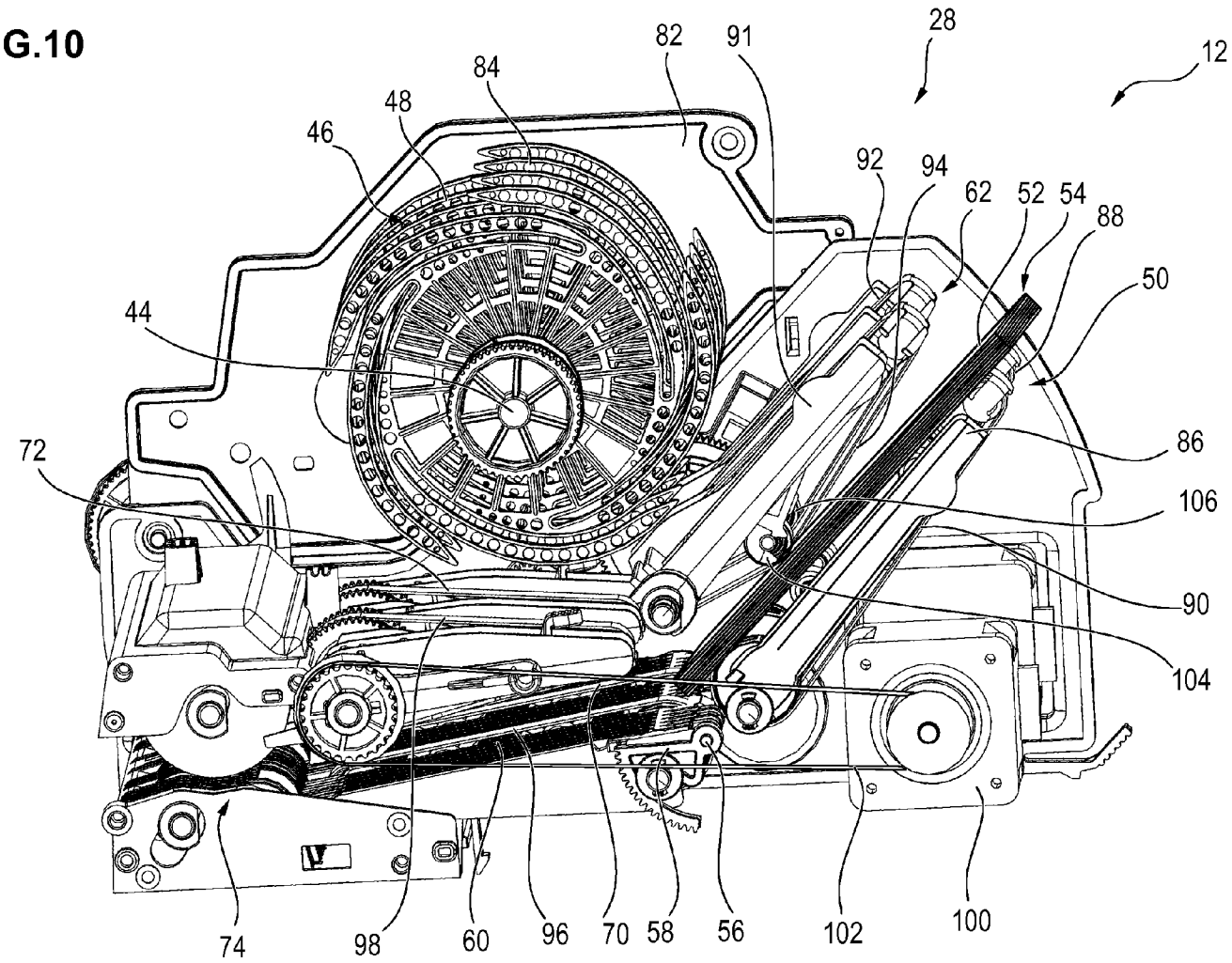
FIG. 10 is a schematic perspective illustration of the collecting unit according to FIGS. 8 and 9 in the third operating state.

FIG. 10 shows a schematic perspective illustration of the arrangement according to FIGS. 8 and 9, wherein the partition element 58 was swiveled via a not-illustrated drive unit from the closed to the open position, so that a not-removed stack of notes of value 54 can be transported to the return transport path 60.

Figure 11:
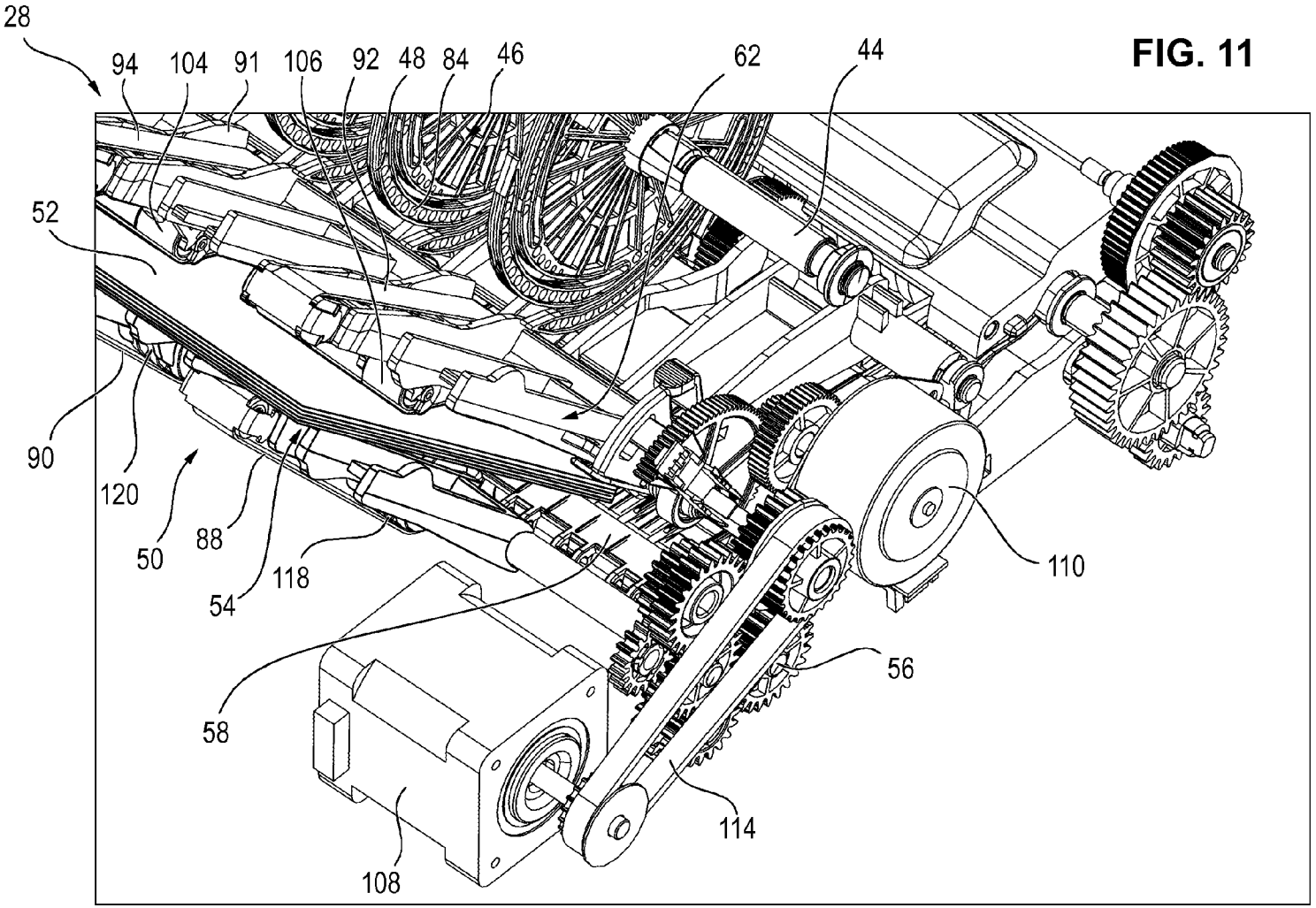
FIG. 11 is a perspective illustration of a section of the collecting unit according to FIGS. 6 to 10.

FIG. 11 shows a section of the arrangement according to FIGS. 8 to 10. The collecting unit 28 comprises two further step motors 108, 110. The further first step motor 108 is connected via a belt 114 and a gear wheel arrangement 112 to a shaft 116 on which two rolls 118, 120 are mounted non-rotatably, via which the belts 88, 90 are guided. If the shaft 116 is driven via the first further step motor 108, the belts 88, 90 are driven as well. The belts 92, 94 of the press-on element 62 are also driven via the first further step motor 108.

Figure 12:
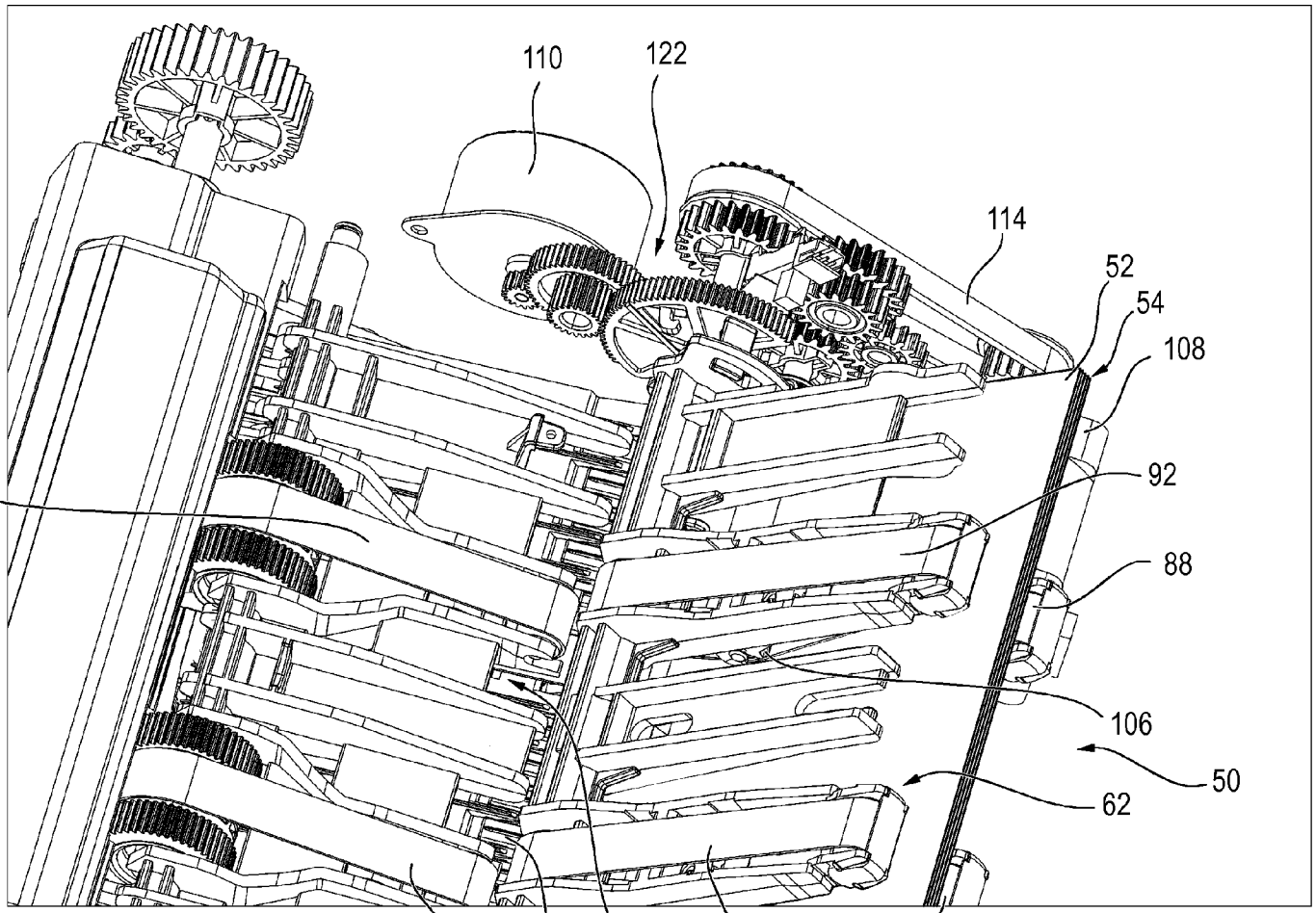
FIG. 12 is a perspective illustration of a further section of the collecting unit according to FIGS. 6 to 11.

The further second step motor 110 is, as shown in FIG. 12, connected to the press-on element 62 by means of a gear stage 122 formed by gearwheels. By means of the second step motor 110 the press-on element 62 can be swiveled between the swiveled-on and the swiveled-away position.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

The invention claimed is:

1. A banknote dispensing device comprising:

a dispensing unit; and a collecting unit configured to collect and stack the banknotes individually transferred thereto by a transport device, the collecting unit includes:

a stacking unit including a plurality of stacker wheels;

a stationary support element, the stacking unit stacks the bank notes to be dispensed onto the support element; and a press-on element configured to rotate about a fixed axis of rotation by a preset angle of rotation between a first position and a second position, in a stacking mode the press-on element is arranged in the first position in which the press-on element is swiveled away from the support element, in a dispensing mode the press-on element is arranged in the second position in which the press-on element is swiveled to the support element to press banknotes against the support element;

wherein the press-on element defines a plurality of openings;

wherein each one of the plurality of stacker wheels protrudes through one of the plurality of openings defined by the press-on element such that portions of the press-on element are between each adjacent pair of the plurality of stacker wheels when the press-on element is arranged in the first position; and wherein when the press-on element is in the first position, each one of the plurality of stacker wheels has the portions of the press-on element on opposite sides thereof.

2. The banknote dispensing device of claim 1, wherein the preset angle of rotation of the press-on element is between 40 degrees and 90 degrees.

3. The banknote dispensing device of claim 1, wherein the collecting unit includes a partition element configured to be swiveled and during stacking of the banknotes is arranged in a closed position to lock a return transport path.

4. The banknote dispensing device of claim 3, further comprising an adjustment unit configured to swivel the partition element.

5. The banknote dispensing device of claim 4, further comprising a drive unit configured to drive a belt for transporting the banknotes to the support element.

6. The banknote dispensing device of claim 1, further comprising a separating unit in a return transport path for separating banknotes.

7. The banknote dispensing device of claim 1, wherein the stacker wheel and the fixed axis of rotation that the press-on element is configured to rotate about are on a common side of the support element.

8. The banknote dispensing device of claim 1, wherein the press-on element is configured such that the press-on element rotates away from the stacker wheel as the press-on element rotates from the first position to the second position.

9. The banknote dispensing device of claim 8, wherein the press-on element is configured such that the press-on element rotates to the stacker wheel as the press-on element rotates from the second position to the first position.

* * * * *